US010920516B2

(12) United States Patent
Parker et al.

(10) Patent No.: US 10,920,516 B2
(45) Date of Patent: Feb. 16, 2021

(54) DEVICE AND METHOD FOR COLLECTING DEBRIS OF DEPOSITS IN A WELLBORE

(71) Applicant: Blue Spark Energy Inc., Calgary (CA)

(72) Inventors: Todd Parker, Calgary (CA); Charles Fensky, Beaumont (CA)

(73) Assignee: Blue Spark Energy Inc., Calgary (CA)

( * ) Notice: Subject to any disclaimer, the term of this patent is extended or adjusted under 35 U.S.C. 154(b) by 0 days.

(21) Appl. No.: 16/363,168

(22) Filed: Mar. 25, 2019

(65) Prior Publication Data

US 2019/0292865 A1 Sep. 26, 2019

Related U.S. Application Data

(60) Provisional application No. 62/648,015, filed on Mar. 26, 2018.

(51) Int. Cl.
*E21B 37/00* (2006.01)
*E21B 27/00* (2006.01)
*E21B 36/04* (2006.01)

(52) U.S. Cl.
CPC ..... *E21B 27/00* (2013.01); *E21B 37/00* (2013.01); *E21B 36/04* (2013.01)

(58) Field of Classification Search
CPC ..... E21B 37/00; E21B 27/005; E21B 27/00; E21B 27/04; E21B 27/02
See application file for complete search history.

(56) References Cited

U.S. PATENT DOCUMENTS 3,118,510 A * 1/1964 Woods ..... E21B 27/00 175/308
3,164,209 A * 1/1965 Owen ..... E21B 37/00 166/107
3,180,418 A * 4/1965 MacLeod ..... E21B 37/00 166/311
5,948,171 A * 9/1999 Grothaus ..... B08B 3/12 134/1
6,745,839 B1 * 6/2004 Simpson ..... E21B 37/04 166/311
2008/0053651 A1 * 3/2008 Hern ..... E21B 37/00 166/173
2011/0290334 A1 * 12/2011 Hern ..... E21B 27/005 137/15.04
2015/0218901 A1 * 8/2015 Juhlin ..... E21B 43/084 166/105.1
2015/0226036 A1 * 8/2015 Wolf ..... E21B 31/00 166/311
2016/0168939 A1 * 6/2016 Harris ..... E21B 27/005 166/250.01

* cited by examiner

*Primary Examiner* — Kipp C Wallace
(74) *Attorney, Agent, or Firm* — Klein, O'Neill & Singh, LLP

(57) ABSTRACT

The invention relates to a collecting device for collecting debris of deposits while said deposits are being removed from a wellbore wall or an equipment arranged in a wellbore of a subterranean formation in order to improve the recovery of formation fluids and/or gases, said collecting device being configured for being attached to a cleaning device, said cleaning device being configured for removing deposits from a wellbore wall or an equipment arranged in a wellbore. The collecting device comprises a deflector, configured for deflecting falling debris of deposits while said deposits are being removed from said wellbore wall or said equipment, and a debris storing module, connected to said deflector for collecting and storing debris deflected by said deflector.

9 Claims, 7 Drawing Sheets

DEVICE AND METHOD FOR COLLECTING DEBRIS OF DEPOSITS IN A WELLBORE

FIELD OF THE INVENTION

The field of the invention relates to well boring and, more particularly, to a device and a method for removing deposits from a wellbore wall or an equipment arranged in a wellbore of a subterranean formation in order to improve the recovery of formation fluids and/or gases. The device and method according to the invention may advantageously be used to remove deposits from e.g. a wellbore wall, a casing, a tubing or a well completion equipment.

BACKGROUND OF THE INVENTION

In the art of well boring, a borehole is drilled into the earth through an oil or gas producing subterranean formation or, for some purposes, through a water bearing formation or a formation into which water or gas or other liquids are to be injected.

Completion of a well may be carried out in a number of ways dependent upon the nature of the formation of interest. In particular, it is known to arrange a casing into the wellbore to control formation elements. Once installed into the wellbore, the casing is then perforated in a plurality of areas for allowing the passage of oil and/or gas from the formation into the casing. In order to produce formation fluids or gases, completion strings are arranged in the borehole. Such a completion string generally comes as a production tubing which comprises a plurality of different equipment such as e.g. safety valves, sliding side doors, side pocket mandrels, etc.

In any event, after a period of production, injection or transportation of fluids or gases, there is a tendency for the wellbore wall and/or different wellbore equipment to become plugged with various types of deposits like e.g. residues. For example, organic residues like scale, paraffin, asphalts and other gummy residues of petroleum origin often cause plugging problems.

Usually these deposits can cause significant problems, because of their composition and the fact that they can precipitate under certain conditions (pressure, temperature, composition). These materials of mineral or organic origins either together with chemicals from water, normally produced with the oil, such as calcium carbonate, calcium sulfate, barium sulfate, sulfur and the like, or such chemicals themselves have a tendency to form extremely hard deposits on the wellbore wall and/or different parts of wellbore equipment. Such deposits can thus adhere to the wellbore wall and/or various equipment arranged in a borehole or a pipeline, restricting their use seriously and/or reducing or completely preventing the flow of fluids or gases through the completion string or the pipeline. For example, deposits may prevent opening or closing safety valves or sliding side doors, etc.

Such deposits are difficult to dissolve by known chemical means or to dislodge by known mechanical means. For example, chemical treatments, such as, treatments with acids, surface active agents and the like have been utilized in order to clean out scaled wellbore wall or equipment. However, such techniques, while less expensive than a complete workover, are substantially less effective, since they are incapable, in most cases, of dissolving significant amounts of the plugging materials. Another technique, which can be classified as a mechanical technique and has also been suggested for the purpose of cleaning wellbore equipment, includes using brushes, scrapers or pigs. Such technique allows only removing most of the encrusted deposits in areas of the wellbore equipment which are easily accessible. However, brushes, scrapers or pigs are quite inefficient removing encrusted deposits in areas of the wellbore equipment accessible with difficulty or inaccessible. Consequently, it is often necessary to rework the well and replace one or several equipment of the completion string or the pipeline. Such tactics are, of course, both time-consuming and expensive.

Another method used for removing deposits consists in using an electrical discharge generating device which generates shock waves for creating an electrohydraulic effect. More precisely, in an existing solution, the electrical discharge generating device comprises electrodes in between which a high-voltage current is discharged. The discharge of said high-voltage current generates high-energy shock waves that transmit in the borehole toward a well completion equipment and/or a tubing and/or a casing, the wellbore wall and the subterranean formation.

When deposits are removed for an equipment or a wellbore wall using these methods, the deposits fall in the wellbore and may block said wellbore or equipment, therefore reducing or preventing the efficiency of oil recovery.

It is therefore an object of the present invention to provide a device and method for avoiding blocking a wellbore or a wellbore equipment with debris of deposits removed from the wellbore wall and/or a wellbore equipment.

SUMMARY OF THE INVENTION

To this end, the present invention concerns a collecting device for collecting debris of deposits while said deposits are being removed from a wellbore wall or an equipment arranged in a wellbore of a subterranean formation in order to improve the recovery of formation fluids and/or gases, said collecting device being configured for being attached to a cleaning device, said cleaning device being configured for removing deposits from a wellbore wall or a wellbore equipment arranged in a wellbore, said collecting device comprising:

- a deflector configured for deflecting falling debris of deposits while said deposits are being removed from said wellbore wall or said wellbore equipment, and
- a debris storing module connected to said deflector, said debris storing module being configured for collecting and storing debris deflected by said deflector.

The collecting device according to the invention allows collecting debris falling by gravity when deposits are removed (i.e. cleaned) from a wellbore wall and/or an equipment arranged in a wellbore. Thus, the collecting device allows thus avoiding debris to fall into the wellbore and block said wellbore and/or some wellbore equipment. The device according to the invention also allows extracting quickly deposits from a wellbore.

In a preferred embodiment, the deflector comprises a tubular portion comprising a first end connected to the debris storing module and a second end configured for collecting debris, said tubular portion being adapted to convey debris from said second end into the debris storing module through said first end.

According to an aspect of the invention, the deflector comprises a connecting shaft mounted on the second end of the tubular portion and configured for attaching the collecting device to a cleaning device.

Preferably, the deflector comprises at least one annular portion extending from the second end of the tubular portion.

In an embodiment, the at least one annular portion extends radially from the second end of the tubular portion.

Preferably, the at least one annular portion is flexible or pliable. This allows said at least one annular portion to abut against the surface to be cleaned, for example a casing or the wellbore wall, in order to avoid debris falling between said surface and the deflector into the wellbore.

In an embodiment, the deflector comprises three annular portions extending from the second end of the tubular portion.

Advantageously, the debris storing module comprises at least one tubular section configured for storing debris.

In an embodiment, the debris storing module comprises a plurality of tubular sections connected together along a same longitudinal axis.

Advantageously, each tubular section comprises a plurality of slots for evacuating liquids and/or gases from the inner part of the debris storing module.

In an embodiment, the collecting device further comprises an unloading plug connected to the debris storing module and being configured for switching between a first position in which the unloading plug prevents the debris stored in the debris storing module to leave said debris storing module and a second position in which the unloading plug allows the debris stored in the debris storing module to leave said debris storing module.

According to an aspect of the invention, the unloading plug comprises a trap door allowing the unloading plug to switch (i.e. move) between the first position and the second position (and vice-and-versa).

Advantageously, the trap door is removable to easily evacuate debris stored in the debris storing module.

In a preferred embodiment, the unloading plug comprises a tubular portion delimiting an internal opening, the trap door being configured to be moved between a blocking position, in which the trap door obstructs said internal opening, and a free position in which debris stored into the debris storing module may flow though said internal opening to unload the said debris storing module.

The invention also relates to an assembly for removing deposits from a wellbore wall or an equipment arranged in a wellbore of a subterranean formation and for collecting debris of said deposits, said assembly comprising a cleaning device configured for removing deposits from said wellbore wall or said equipment and a collecting device as previously presented, said collecting device being attached below said cleaning device in order to collect debris from deposits removed by the cleaning device.

According to an embodiment, the cleaning device and the collecting device extend along a same longitudinal axis in order to ease the use of the assembly in the wellbore, in particular to insert or withdraw the assembly from the wellbore.

The invention also relates to a method for collecting debris of deposits in a wellbore of a subterranean formation in order to improve the recovery of formation fluids and/or gases, said method comprising the steps of:

- removing deposits from a wellbore wall or an equipment arranged in a wellbore using a cleaning device,
- collecting falling debris of deposits, using a collecting device, as previously presented, attached below said cleaning device, while said deposits are being removed from said wellbore wall or said equipment by the cleaning device.

Advantageously, the collecting step comprises deflecting the debris so that said debris are received by the second end of the tubular portion of the deflector, conveying the debris from the second end of the deflector to the debris storage module through said tubular portion of the deflector and storing the debris into the debris storage module.

In an embodiment, the method further comprises a step of unloading the debris stored in the debris storage module.

In a preferred embodiment, the unloading step comprises opening or removing a trap door to open the unloading plug and unload the collecting device.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
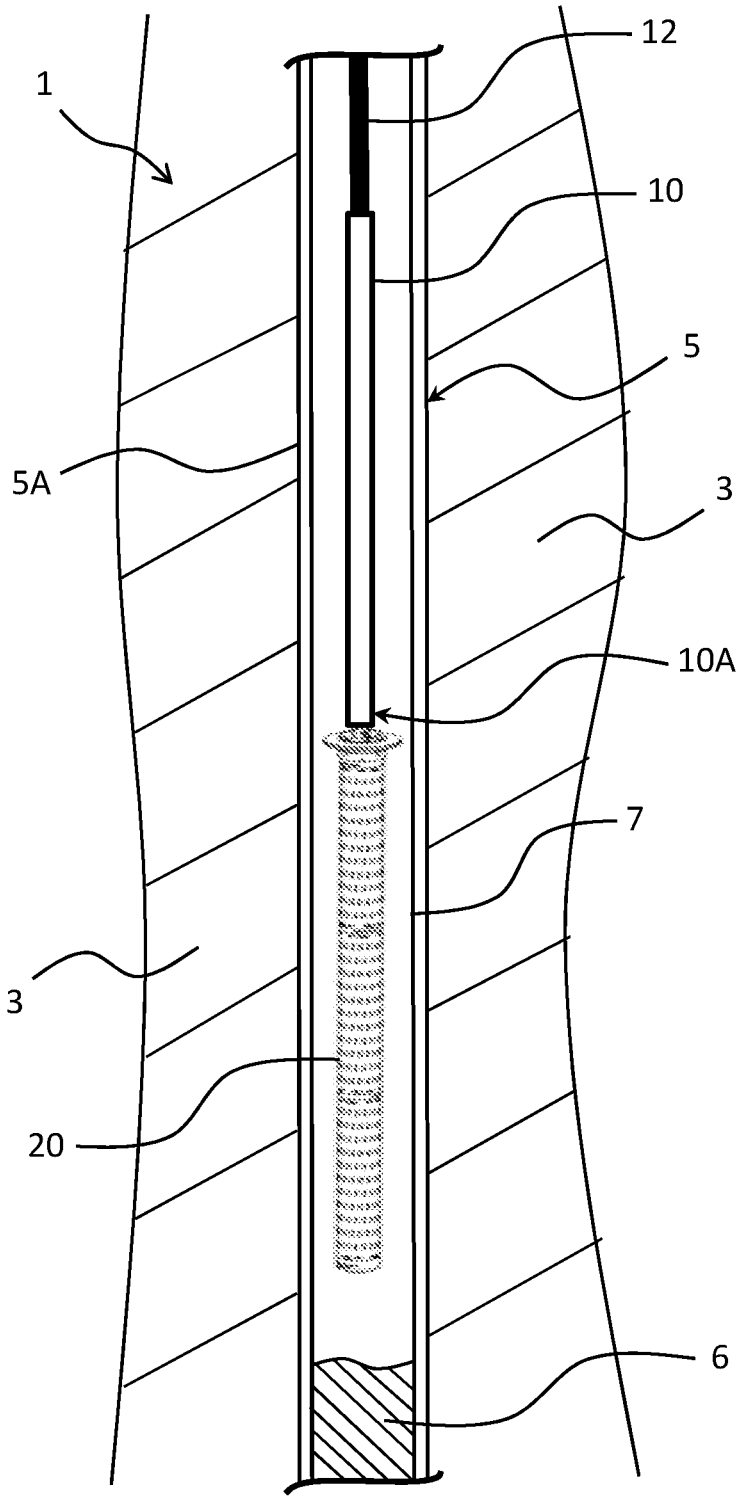
FIG. 1 schematically illustrates a cross-sectional view of a wellbore comprising a casing in which is arranged an embodiment of an assembly according to the invention.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims. Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise. As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated. Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided. Where the Specification and appended Claims reference a method comprising two or more defined steps, the defined steps can be carried out in any order or simultaneously except where the context excludes that possibility.

The invention is described hereunder in reference to a well for producing formation fluids or gases such as e.g. oil. This does not limit the scope of the present invention which may be used with any type of formation.

FIG. 1 shows a subterranean formation 1 comprising a treatment zone 3. For example, such a treatment zone 3 may be made of rock. The treatment zone 3 may comprise a porous zone that constitutes a reservoir of hydrocarbons, such as oil or gas. The porous zone is accessible through a wellbore 5 extending from the surface through to the treatment zone 3. The treatment zone 3 interfaces with the wellbore 5 at wellbore wall 5A and extends radially from wellbore 5.

In the example illustrated on FIG. 1, a wellbore equipment constituted of a metallic casing 7 is arranged in the wellbore 5. This casing 7 may comprise perforations that allow creating some flow paths within the treatment zone 3 adjacent to the wellbore 5. In another embodiment, the wellbore equipment could be for example a completion string equipment, a production tubing element or any type of equipment arranged in the wellbore 5.

The wellbore 5 may be partially filled with a liquid, called "wellbore liquid" 6 that reaches a given wellbore liquid 6 level in such a manner that some parts of the casing 7 are arranged above said wellbore liquid level (i.e. in a dry volume of the wellbore 5), whereas some parts of the casing 7 are arranged under the wellbore liquid 6 level. Alternatively, the wellbore 5 could be completely dry (i.e. deprived of liquid).

As illustrated on FIG. 1, an electrical discharge generating device 10 is arranged in the wellbore 5. The electrical discharge generating device 10 is configured for generating electrical discharges that propagate shock waves 11 (FIG. 12), in particular for cleaning the casing 7 in order to improve the recovery of formation fluids and/or gases. In this illustrated example, the electrical discharge generating device 10 constitutes a source of electrohydraulic energy that can be arranged into the wellbore 5 near (i.e. next to) a part of the casing 7 that needs cleaning, in particular to remove deposits 8 stuck on or inside said casing 7 as shown on FIG. 12.

The electrical discharge generating device 10 is coupled to a wireline 12 which is operable to raise and lower said electrical discharge generating device 10 and to supply power from the surface to said electrical discharge generating device 10. A voltage source (not shown) located external of the wellbore 5 and an electrical circuit (not shown) mounted within said wireline 12 allow to connect said voltage source to the electrical discharge generating device 10. Electrical power is supplied by the low voltage source at a steady and relatively low power from the surface through the wireline 12 to the downhole electrical discharge generating device 10.

In this exemplary embodiment, the electrical discharge generating device 10 has a substantially cylindrically shape and may comprises, as already described in U.S. Pat. No. 4,345,650 issued to Wesley or U.S. Pat. No. 6,227,293 issued to Huffman, incorporated hereby by reference, a power conversion unit, a power storage unit, a control unit and a discharge unit.

Figure 12:
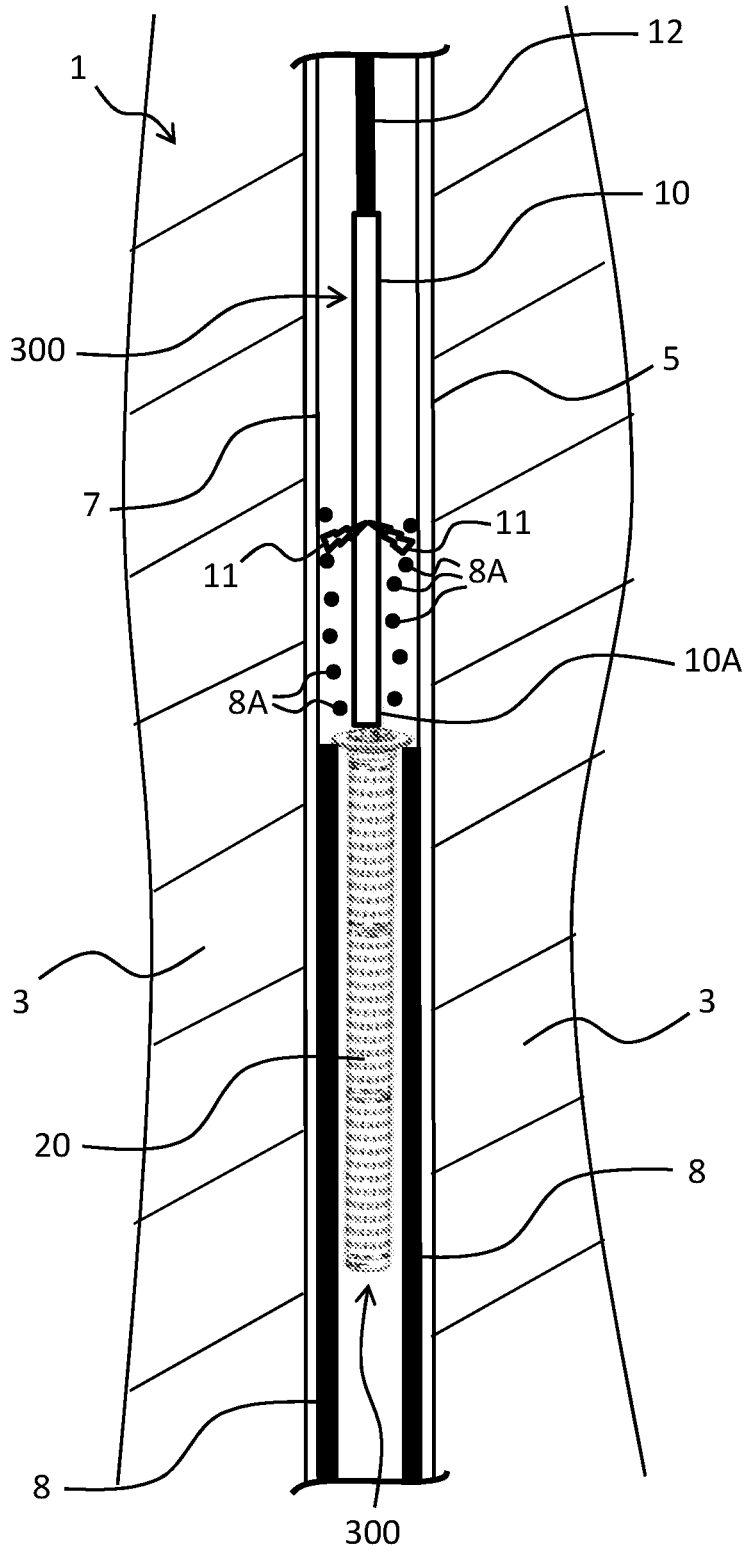
FIG. 12 schematically illustrates a collection of debris using the collecting device of FIG. 2.

As illustrated on FIG. 1, an example of collecting device 20 according to the invention is attached to the bottom end 10A of the electrical discharge generating device 10 in order to collect debris 8A of deposits 8 that are removed from the casing 7 by said electrical discharge generating device 10 as shown on FIG. 12.

FIGS. 2 to 5 show an exemplary embodiment of a collecting device 20 according to the invention. The collecting device 20 according to the invention allows collecting debris 8A of deposits 8 while said deposits 8 are being removed from the casing 7 in order to improve the recovery of formation fluids and/or gases.

In this example, as illustrated on FIGS. 2 to 5, the collecting device 20 is of cylindrical shape having a circular section and comprises a plurality of elements. The collecting device 20 comprises a deflector 210 and a debris storing module 220.

The deflector 210 is configured for deflecting falling debris 8A of deposits 8 being removed from the casing 7 by the electrical discharge generating device 10.

Figure 5:
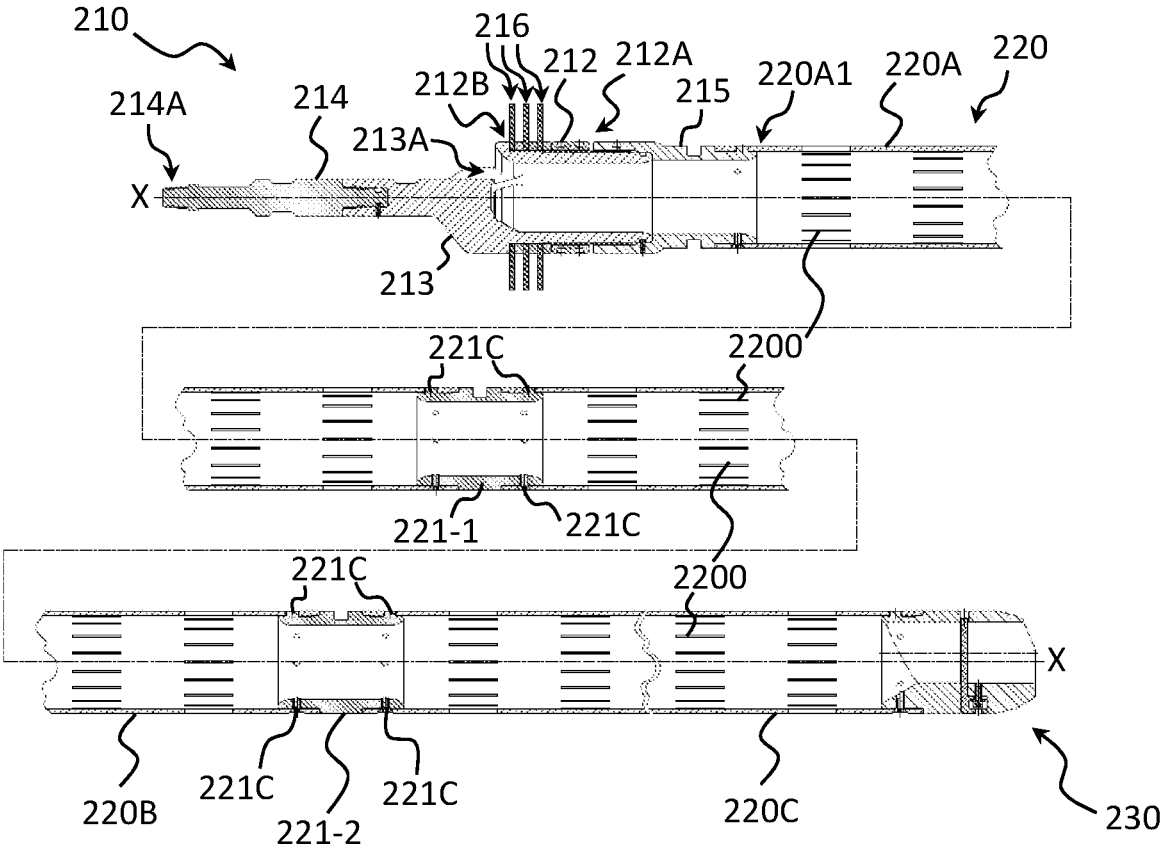
FIG. 5 schematically illustrates a partial exploded view of the collecting device of FIG. 2.
Figure 6:
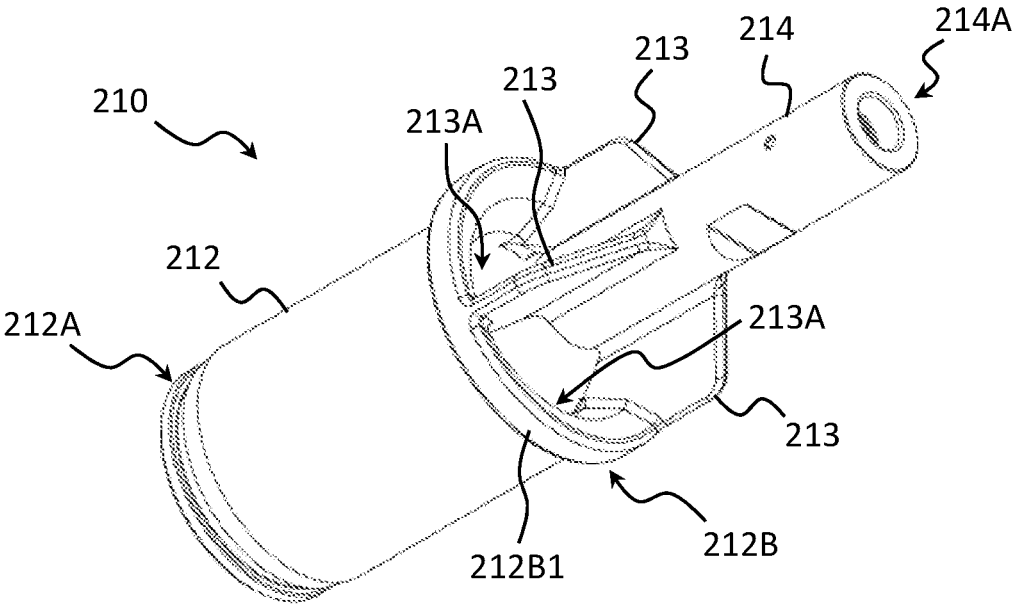
FIG. 6 schematically illustrates a perspective view of the deflector of the collecting device of FIG. 2.

In reference to FIGS. 5 and 6, the deflector 210 comprises a tubular portion 212 comprising a first end 212A, adapted to be connected to the debris storing module 220 via an adapter 215, and a second end 212B configured for collecting debris 8A. The tubular portion 212 is adapted to convey debris 8A from said second end 212B through said first end 212A into the debris storing module 220.

The deflector 210 comprises a connecting shaft 214 extending from the second end 212B of the tubular portion 212 and comprising a free end 214A which is configured for attaching the collecting device 20 to the electrical discharge generating device 10. For example, the free end 214A of the connecting shaft 214 may comprise a hollow central portion which allow inserting a rod (not shown) protruding from the bottom end 10A of the electrical discharge generating device 10.

As illustrated on FIG. 6, the second end 212B of the tubular portion 212 comprises an annular flange 212B1 from which extend three wings 213 and in which are formed three openings 213A delimited between said wings 213. The wings 213 allow reinforcing the deflector 210 and guiding debris 8A toward openings 213A into the tubular portion 212.

In the example illustrated on FIG. 5, the deflector 210 comprises three annular portion 216 mounted around the annular flange 212B1 and the second end 212B of the tubular portion 212. The annular portion 216 aims the debris 8A removed from the casing 7 into the inner flow path of openings 213A of the deflector 210. The annular portions 216 are made with a pliable or flexible material such that contact is maintained between the deflector 210 and the wellbore wall 5A or casing 7 (or deposits 8—see FIG. 12) so that all material is directed into the openings 213A and collected by the collecting device 20.

Figure 2:
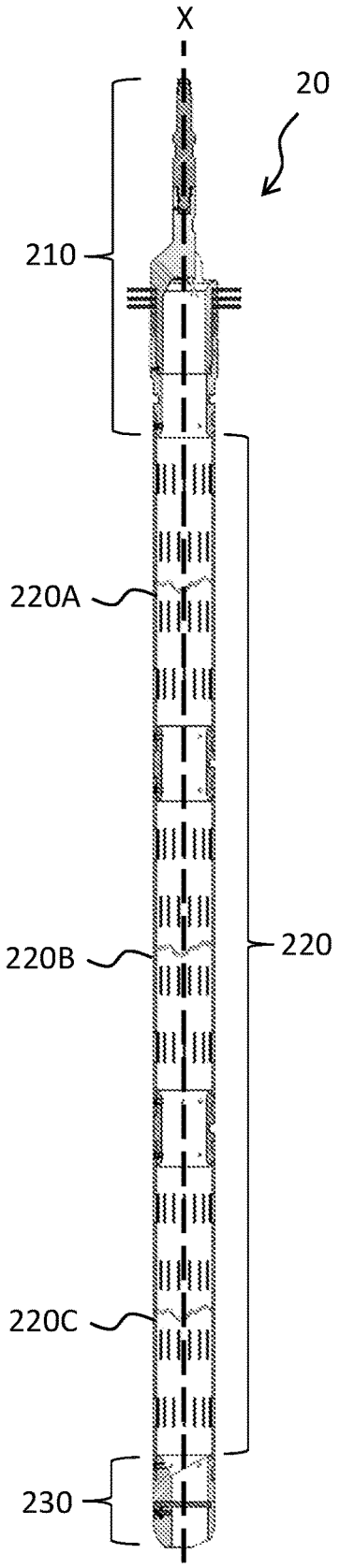
FIG. 2 schematically illustrates a side view of an embodiment of a collecting device according to the invention.
Figure 3:
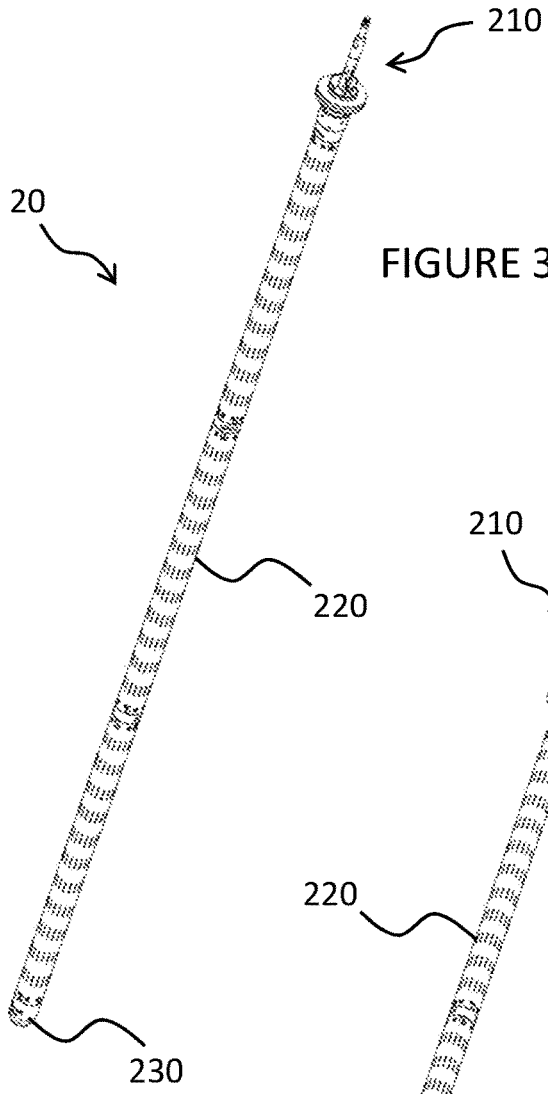
FIG. 3 schematically illustrates a perspective view of the collecting device of FIG. 2.
Figure 4:
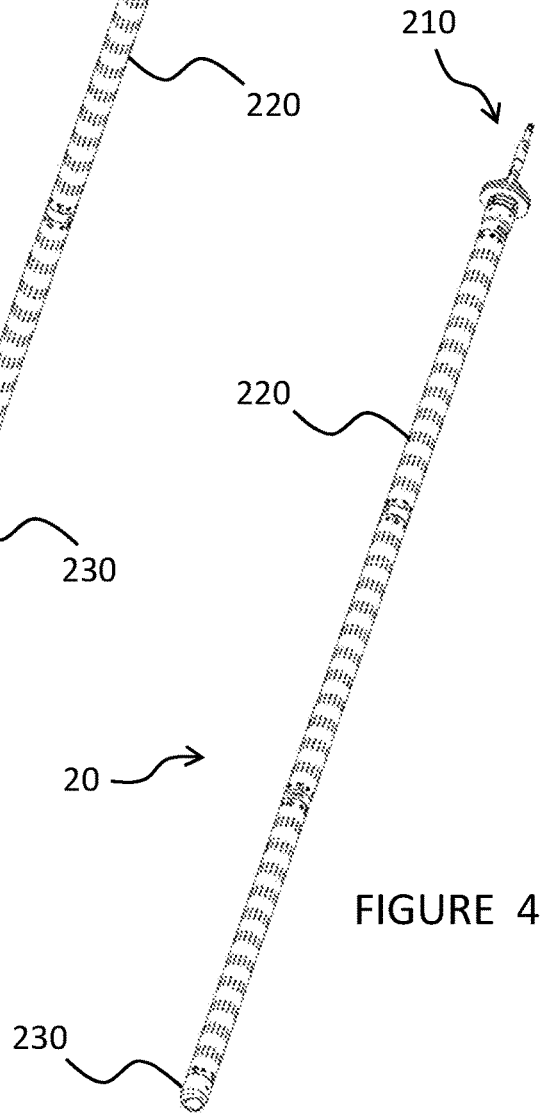
FIG. 4 schematically illustrates another perspective view of the collecting device of FIG. 2.

As illustrated on FIGS. 2 to 5, the debris storing module 220 comprises three tubular sections, namely a first tubular section 220A, a second tubular section 220B and a third tubular section 220C connected together along a same longitudinal axis X (FIGS. 2 and 5). In another embodiment, the debris storing module 220 could comprise more or less than three tubular sections. As illustrated on FIG. 5, each of the first tubular section 220A, the second tubular section 220B and the third tubular section 220C comprises a plurality of slots 2200 which allow liquids that enter into the debris storing module 220 via the deflector 210 to be evacuated. More precisely, the dimensions of the slots 2200 are adapted to allow liquids that enter into the debris storing module 220 via the deflector 210 to be evacuated while debris 8A stored inside the first tubular section 220A, second tubular section 220B and/or third tubular section 220C remain inside the debris storing module 220.

Figure 7:
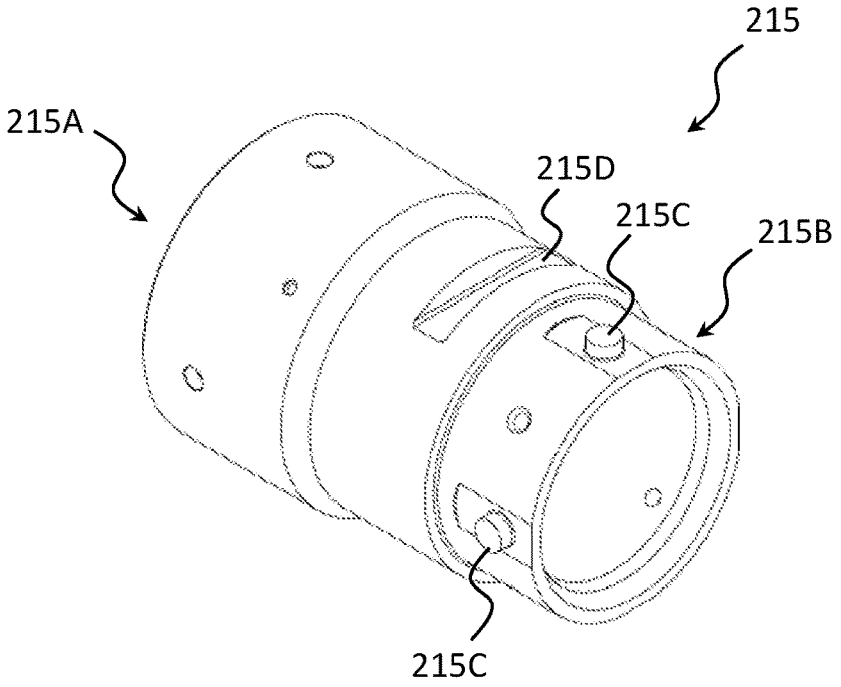
FIG. 7 schematically illustrates a perspective view of the adapter of the collecting device of FIG. 2.

The debris storing module 220 is configured to be connected to the deflector 210 for storing debris 8A deflected by said deflector 210. To this end, the collecting device 20 comprises an adapter 215, shown on FIG. 7, which allows connecting the first end 212A of the tubular portion 212 of the deflector 210 to an end 220A1 of the first tubular section 220A as shown on FIG. 5. In this example, the adapter 215 comprises a first end 215A of tubular shape, adapted to receive the first end 212A of the tubular portion 212 of the deflector 210, for example by clipping or press-fitting, and a second end 215B, also of tubular shape but of a smaller diameter, and which is adapted to be inserted into the corresponding end 220A1 of the first tubular section 220A. In order to fix the end 220A1 of the first tubular section 220A to the second end 215B of the adapter 215, the adapter 215 comprises a plurality of pins 215C (FIG. 7) which are configured to fit into corresponding plurality of holes (not visible) forms onto the end 220A1 of the first tubular section 220A. The adapter 215 also comprise two grooved portions 215D formed on opposite parts of the side wall of the adapter 215 for carrying the collecting device 20 with a lifting tool such as e.g. a crane or a forklift.

As shown on FIG. 5, the collecting device 20 also comprises a first section connector 221-1 and a second section connector 221-2. The first section connector 221-1 allows connecting the first tubular section 220A and the second tubular section 220B. The second section connector 221-2 allows connecting the second tubular section 220B and the third tubular section 220C.

Figure 8:
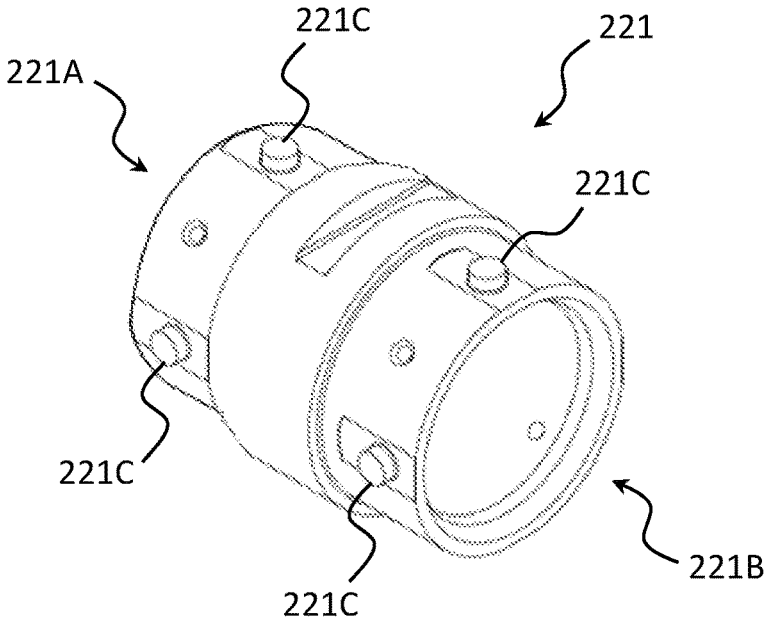
FIG. 8 schematically illustrates a perspective view of a section connector of the collecting device of FIG. 2.

As illustrated on FIG. 8, a section connector 221, such as the first section connector 221-1 and the second section connector 221-2, has a tubular shape and comprises two ends 221A, 221B adapted to be inserted into a corresponding end of the first tubular section 220A, the second tubular section 220B and the third tubular section 220C. The section connector 221 is fixed to the first tubular section 220A, second tubular section 220B and third tubular section 220C by clipping using pins 221C protruding from ends 221A, 221B of said section connector 221.

In this preferred embodiment, the collecting device 20 further comprises an unloading plug 230 that allows evacuating easily the debris 8A stored in the debris storage module 220, in particular when the debris storage module 220 is full and/or when the collecting device 20 is pulled out of the wellbore 5.

To this end, the unloading plug 230 is connected to the debris storing module 220 and is configured to be placed in a first configuration, in which the unloading plug 230 prevents the debris 8A stored in the debris storing module 220 to leave said debris storing module 220, and a second configuration, in which the unloading plug 230 allows the debris 8A stored in the debris storing module 220 to leave said debris storing module 220.

Figure 9:
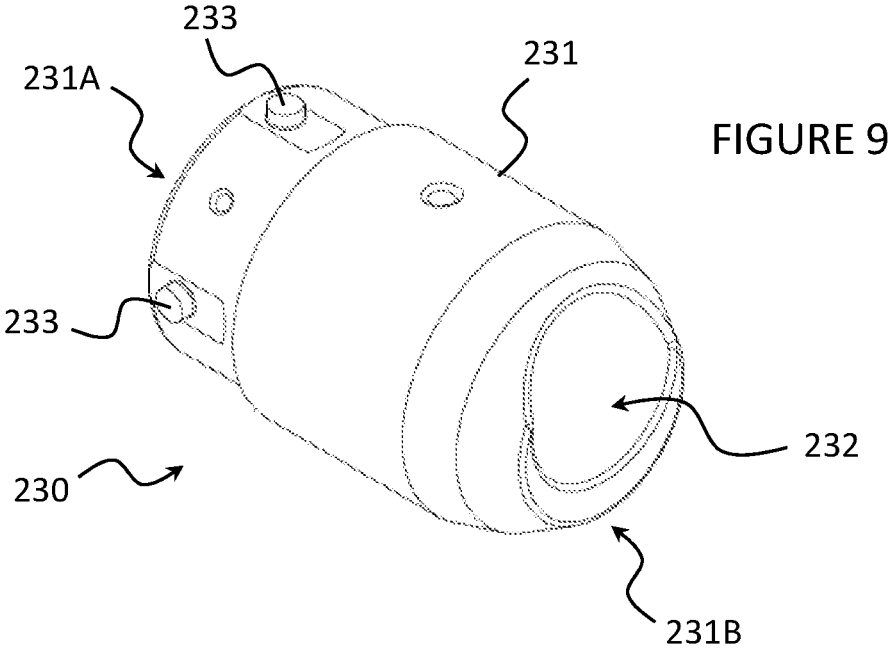
FIG. 9 schematically illustrates a perspective view of the unloading plug of the collecting device of FIG. 2.
Figure 10:
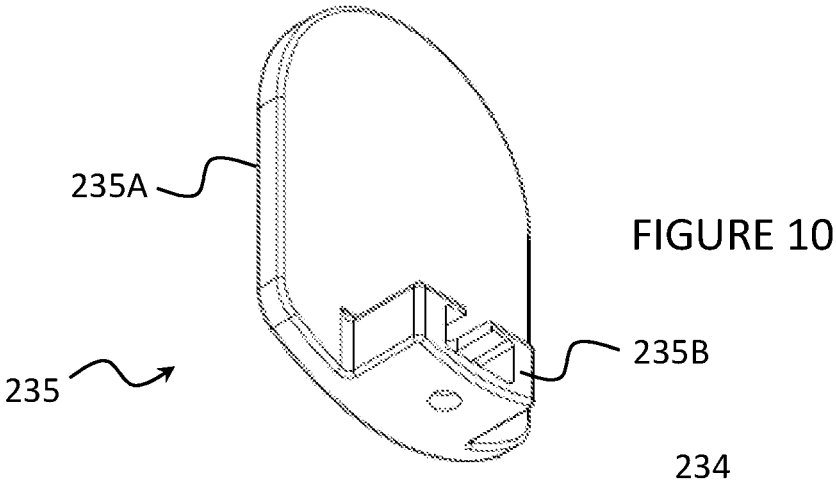
FIG. 10 schematically illustrates a perspective view of the trap door of the unloading plug of the collecting device of FIG. 2.
Figure 11:
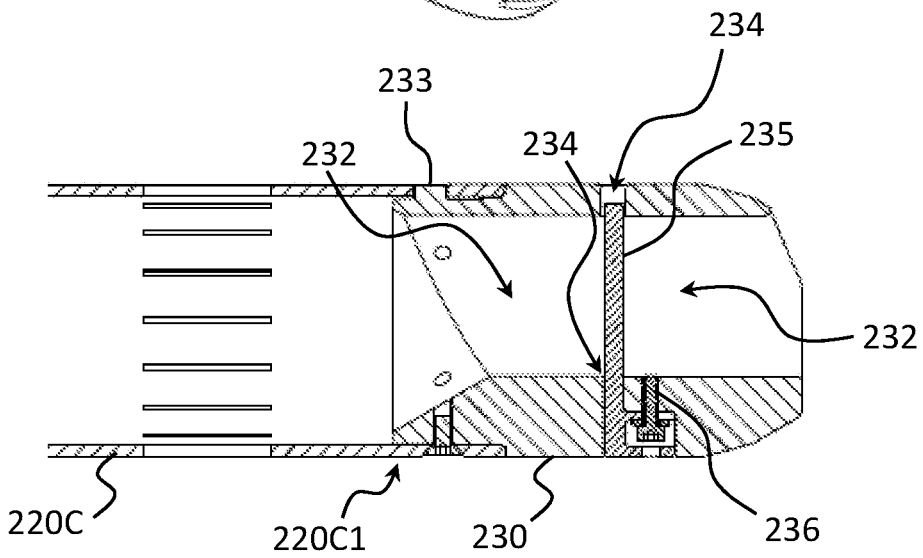
FIG. 11 schematically illustrates a cross-sectional view of the unloading plug of FIG. 9, the trap door of FIG. 10 being mounted on said unloading plug.

In reference to FIGS. 9 to 11, the unloading plug 230 comprises a connecting end 231A, a tubular portion 231 delimiting an internal opening 232, a free end 231B and a trap door 235. In the example illustrated on FIG. 9, the connecting end 231A comprises pins 233 protruding from said connecting end 231A, which are configured to engage with holes formed in the end 220C1 of the third tubular section 220C in order to fix the unloading plug 230 on the third tubular section 220C by clipping. As shown on FIG. 11, the tubular portion 231 comprises a slot 234 formed in the side wall of said tubular portion 231, which is configured for receiving the trap door 235.

The trap door 235, illustrated on FIG. 10, may be mounted in a removable manner in the slot 234 of the tubular portion 231. In this exemplary embodiment, the trap door 235 is a one-piece element comprising a plate portion 235A and a connection portion 235B extending perpendicularly from said plate portion 235A and which is configured for receiving a screw 236 (FIG. 11) allowing fixing the trap door 235 on the tubular portion 231.

Thus, when the trap door 235 is mounted in the slot 234 of the tubular portion 231, in a position called blocking position, the trap door 235 obstruct entirely the internal opening 232 of the tubular portion 231 to prevent the debris 8A from leaving the debris storing module 220 (first configuration of the unloading plug 230).

When the trap door 235 is removed from the slot 234 of the tubular portion 231 (called free position), the internal opening 232 of the tubular portion 231 allows debris 8A to leave the debris storing module 220 to empty said debris storing module 220 from debris 8A (second configuration of the unloading plug 230).

Figure 13:
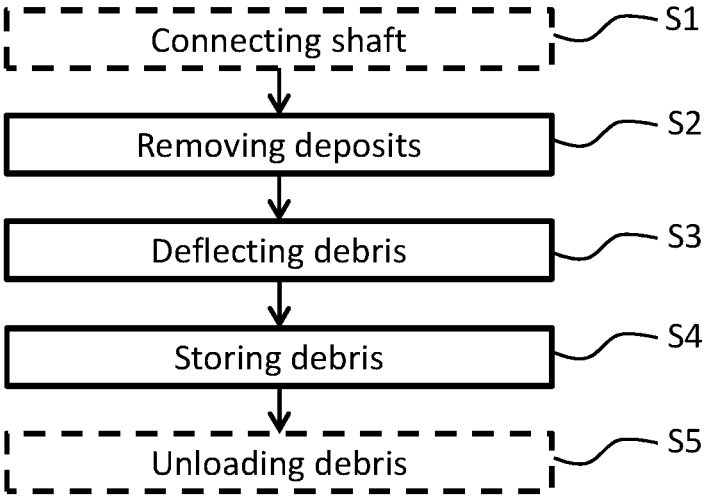
FIG. 13 schematically illustrates an exemplary embodiment of the method according to the invention.

An exemplary embodiment of the method according to the invention will now be described in reference to FIG. 13.

In a step S1, the connecting shaft 214 of the collecting device 20 is first attached to the bottom end 10A of the electrical discharge generating device 10, extending along the same longitudinal axis X, to form an assembly 300 which is then lowered inside the casing 7 down the wellbore 5 using the wireline 12.

When the electrical discharge generating device 10 is arranged near a portion of the casing 7 which needs to be cleaned from deposits 8, the electrical discharge generating device 10 is activated to generate electrical discharges that propagate shock waves 11 to remove deposits 8 from the casing 7 internal wall in a step S2.

When debris 8A of deposits 8 being removed fall under the effect of gravity, the deflector 210, and in particular the annular portions 216, deflect said debris 8A, in a step S3, toward the openings 213A so that said debris 8A go through the tubular portion 212 up to debris storing module 220 where the debris 8A are stored in a step S4.

The assembly 300 formed of the electrical discharge generating device 10 and the collecting device 20 may then be moved toward another portion of the casing 7 that needs to be cleaned from deposits 8.

When the debris storing module 220 is full or when the casing 7 is clean from deposits 8 or when the debris storing module 220 is full, the assembly 300 may be pulled out of the wellbore 5 and the trap door 235 may be open, by removing screw 236, to unload debris 8A stored in the debris storing module 220 in a step S5.

In the exemplary embodiment described here above, the cleaning device is an electrical discharge generating device. However, in another embodiment, the cleaning device could be any type of device adapted to remove the deposits for a wellbore wall 5A or an equipment arranged in a wellbore 5.

The device and method according to the invention allow therefore efficiently, rapidly and easily collect deposits that are removed from a wellbore wall and/or a wellbore equipment.

Table of references

| | |
|---|---|
| 1 | subterranean formation |
| 3 | treatment zone |
| 5 | wellbore |
| 6 | wellbore liquid 6 |
| 7 | casing |
| 8 | deposits |
| 8A | debris |
| 10 | electrical discharge generating device |
| 10A | bottom end |
| 11 | shock wave |
| 12 | wireline |
| 20 | collecting device |
| 210 | deflector |
| 212 | tubular portion |
| 212A | first end |
| 212B | second end |
| 212B1 | annular flange |
| 213 | wings |
| 213A | openings |
| 214 | connecting shaft |
| 214A | free end |
| 215 | adapter |
| 215A | first end |
| 215B | second end |
| 215C | pin |
| 215D | grooved portion |
| 216 | annular portion |
| 220 | debris storing module |
| 2200 | slot |
| 220A | first tubular section |
| 220A1 | end |
| 220B | second tubular section |
| 220C | third tubular section |
| 220C1 | end |
| 221 | section connector |
| 221A | end |
| 221B | end |
| 221-1 | first section connector |
| 221-2 | second section connector |

-continued

Table of references

| | |
|---|---|
| 221C | pin |
| 230 | unloading plug |
| 231 | tubular portion |
| 231A | connecting end |
| 231B | free end |
| 232 | internal opening |
| 233 | pin |
| 234 | slot |
| 235 | trap door |
| 235A | plate portion |
| 235B | connection portion |
| 236 | screw |
| 300 | assembly |

The invention claimed is:

1. An assembly for removing deposits from a wellbore wall or an equipment arranged in a wellbore of a subterranean formation and for collecting debris of said deposits, said assembly comprising:

a cleaning device comprising an electrical discharge generating device configured for generating electrical discharges that propagate shock waves for removing deposits from said wellbore wall or said equipment, said electrical discharge generating device comprising a rod for mounting the collecting device;

a collecting device attached below said cleaning device via said rod in order to collect debris from deposits removed by the cleaning device;

said collecting device comprising:

a deflector configured for deflecting falling debris of deposits while said deposits are being removed from said wellbore wall or said wellbore equipment; and a debris storing module connected to said deflector and configured for collecting and storing debris deflected by said deflector, said debris storing module comprising at least one tubular section, each tubular section comprising a plurality of slots;

said deflector comprising:

a tubular portion comprising a first end connected to the debris storing module and a second end configured for collecting debris, said tubular portion being adapted to convey debris from said second end into the debris storing module through said first end;

a connecting shaft mounted on the second end of the tubular portion and attaching the collecting device to the rod of the electrical discharge generating device;

a plurality of wings delimiting openings for reinforcing said deflector and for guiding debris into said openings into the tubular portion; and an unloading plug connected to the debris storing module and being configured for switching between a first position in which the unloading plug prevents the debris stored in the debris storing module to leave said debris storing module and a second position in which the unloading plug allows the debris stored in the debris storing module to leave said debris storing module.

2. The collecting device according to claim 1, wherein the deflector comprises at least one annular portion extending from the second end of the tubular portion.

3. The collecting device according to claim 1, wherein the debris storing module comprises a plurality of tubular sections connected together along a same longitudinal axis.

4. The collecting device according to claim 1, wherein the unloading plug comprises a tubular portion delimiting an internal opening.

5. The collecting device according to claim 1, wherein the unloading plug comprises a trap door allowing the unloading plug to switch between the first position and the second position.

6. The collecting device according to claim 5, wherein the trap door is removable.

7. The collecting device according to claim 6, wherein the trap door is configured to be moved between a blocking position, in which the trap door obstructs said internal opening, and a free position in which debris stored into the debris storing module may flow though said internal opening to unload the said debris storing module.

8. The assembly according to claim 3, wherein the cleaning device and the collecting device extend along a same longitudinal axis.

9. A method for collecting debris of deposits in a wellbore of a subterranean formation in order to improve the recovery of formation fluids and/or gases, said method comprising the steps of:

removing deposits from a wellbore wall or an equipment arranged in a wellbore using the electrical discharge generating device of an assembly according to claim 1; and collecting falling debris of deposits, using the collecting device of said assembly according to claim 1 while said deposits are being removed from said wellbore wall or said equipment by the electrical discharge generating device.

* * * * *